US005156023A

United States Patent [19]

Bevolo

[11] Patent Number: 5,156,023

[45] Date of Patent: Oct. 20, 1992

[54] MULTI-PURPOSE PIN FOR SUPPORTING JEWELRY OR CLOTHING ACCESSORIES

[76] Inventor: Linda Bevolo, 3229 Fairwood Dr., Garland, Tex. 75040

[21] Appl. No.: 400,825

[22] Filed: Aug. 3, 1989

[51] Int. Cl.[5] ..... A44C 1/00

[52] U.S. Cl. ..... 63/20; 24/103; 24/113 MP

[58] Field of Search ..... 63/1.1, 2, 20, 29.1; 24/351, 352, 317, 113 MP, 103; 40/1.5, 1.6; D11/95, 116

[56] References Cited

U.S. PATENT DOCUMENTS

| | | | |
|---|---|---|---|
| D. 156,073 | 11/1949 | Campbell | D11/116 |
| 677,210 | 6/1901 | Harris | 24/103 |
| 699,436 | 5/1902 | Ayers et al. | 24/103 |
| 785,460 | 3/1905 | Whitsett | 40/1.5 |
| 1,305,017 | 5/1919 | Shiman | 63/20 |
| 2,594,475 | 4/1952 | Meyer | 63/2 |

*Primary Examiner*—James R. Brittain
*Assistant Examiner*—J. Bonifanti
*Attorney, Agent, or Firm*—Michael F. Heim

[57] ABSTRACT

A multi-purpose pin which supports jewelry and clothing accessories to the clothing, hat or hair of a wearer. The multi-purpose pin comprises a hoop with fastening means for attaching to the clothing of a wearer. A bar divides the interior portion of the hoop into a plurality of areas, through which a clothing accessory passes to wrap around the bar, thereby securing the clothing accessory to the pin. The bar may include a horizontal and a vertical passage therethrough for supporting jewelry accessories. A plurality of bars may be provided to alter the manner in which the clothing accessory is secured to the pin. A pair of hoops may be provided to define a circumferential groove around the pin for wrapping the clothing accessory. The multi-purpose pin may be used with or without backing, or with a decorative top as an independent jewelry item.

19 Claims, 4 Drawing Sheets

MULTI-PURPOSE PIN FOR SUPPORTING JEWELRY OR CLOTHING ACCESSORIES

BACKGROUND OF THE INVENTION

This invention relates generally to an article of jewelry. More particularly, the present invention relates to an article for supporting jewelry or clothing items while the article itself attaches securely to the clothing of a wearer.

Typically, jewelry items are dedicated for use as one distinctive type of jewelry. For example, an earring is used almost exclusively by attaching it to an ear. Others in the jewelry industry have recognized the advantage of providing an article which permits an item of jewelry to be used interchangeably for a variety of applications. In U.S. Pat. No. 4,655,054, an interchangeable jewelry assembly is provided to increase the utilization of individual jewelry ornaments. The interchangeable jewelry assembly of U.S. Pat. No. 4,655,054 permits a jewelry item to be fastened in various ways to the wearer, thus enabling the jewelry item to be used as various jewelry pieces.

Similarly, clothing accessories, such as scarves, typically are tied to the wearer or else fastened by a pin to the wearer. A problem arises if the accessory is tied to the wearer because there are limited locations where such tying can occur on the anatomy of the person wearing the accessory.

Similarly, the use of a pin to fasten the accessory also causes problems in that the pin increases the susceptibility of the cloth material to tear. In addition, the use of a pin may be aesthetically objectionable in certain circumstances.

SUMMARY OF THE INVENTION

Accordingly, the present invention provides a multi-purpose pin which fastens to the clothing of a wearer and which provides support for other jewelry items or clothing accessories. The multi-purpose pin permits jewelry or clothing accessories to be freely interchanged with the pin without damage to the jewelry or cloth. In addition, the pin itself can serve as a base for other ornamental pieces.

The multi-purpose pin includes an oval hoop with a bar dissecting the hoop. Clothing accessories, such as a scarf, may be passed through the oval and wrapped around the bar to secure the scarf to the wearer. The bar may include apertures through which earrings or pins may be received to provide additional ornamentation. A fastener pin secures to the oval hoop to attach the oval hoop to the clothing of a wearer.

Additional bars also may be provided to provide alternative configurations to the wearer. Similarly, a decorative cover may be fixedly attached to the pin to provide additional ornamentation. The pin also may be used with accessories such as scarves or bows in hair arrangements. These and various other characteristics and advantages of the present invention will become more readily apparent to those skilled in the art upon reading the following detailed description and claims and by referring to the accompanying drawings.

BRIEF DESCRIPTION OF THE DRAWINGS

For a more detailed description of the preferred embodiment of the invention, reference will now be made to the accompanying drawings, wherein.

DETAILED DESCRIPTION OF THE INVENTION

Figure 1:
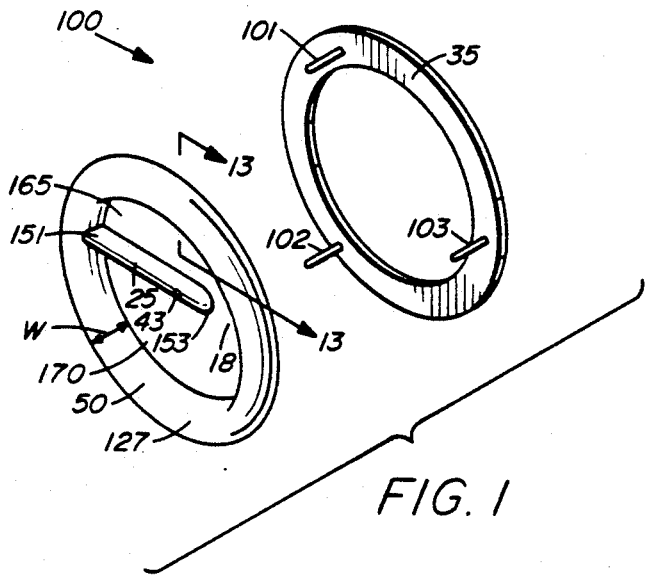
FIG. 1 is a perspective view of the multi-purpose pin constructed in accordance with the preferred embodiment.

Referring now to FIG. 1, the multi-purpose pin 100 constructed in accordance with the preferred embodiment includes an oval or circular hoop 50, a bar 25 bisecting hoop 50, and backing 35, which attaches to hoop 50 by suitable fastening means such as by pins 101, 102, 103.

Hoop 50 preferably has a doughnut-shaped configuration with a suitable outer diameter for receiving clothing accessories. In the preferred embodiment, the hoop 50 has an inner diameter ranging from 0.5 inch to 3.0 inches and an outer diameter ranging from 0.75 inch to 4.0 inches. Other size diameters may be used, however, without departing from the principles of the present invention.

Referring still to FIG. 1, the hoop 50 has a width (w) which must be of sufficient dimension to stably support clothing and jewelry accessories while at the same time being light enough to be worn comfortably. In the preferred embodiment, the hoop 50 has a width ranging from 0.125 inch to 1.0 inch.

Figure 9D:
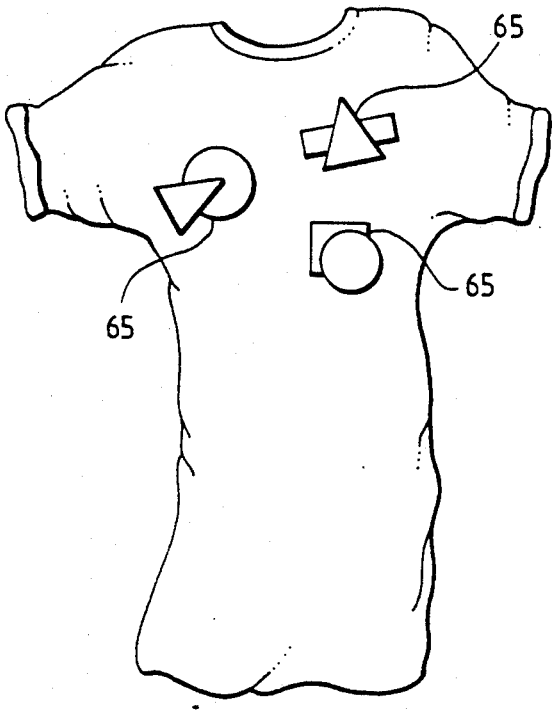
Figure 9F:
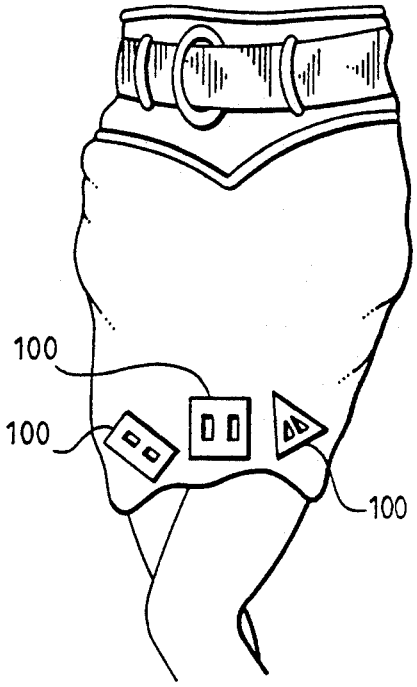
Figure 9E:
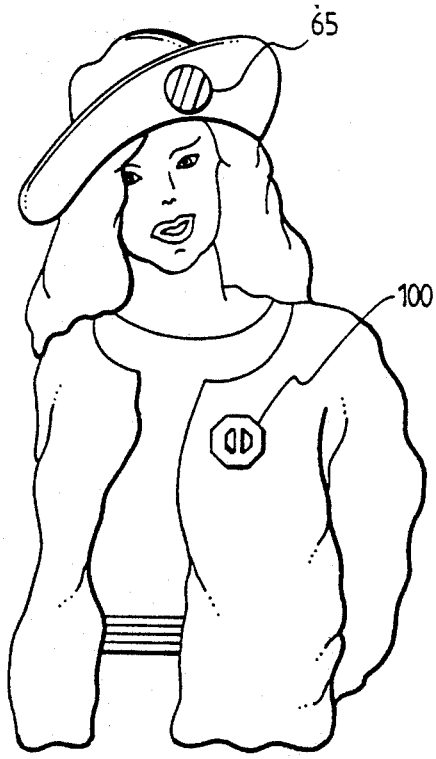
Figure 9G:
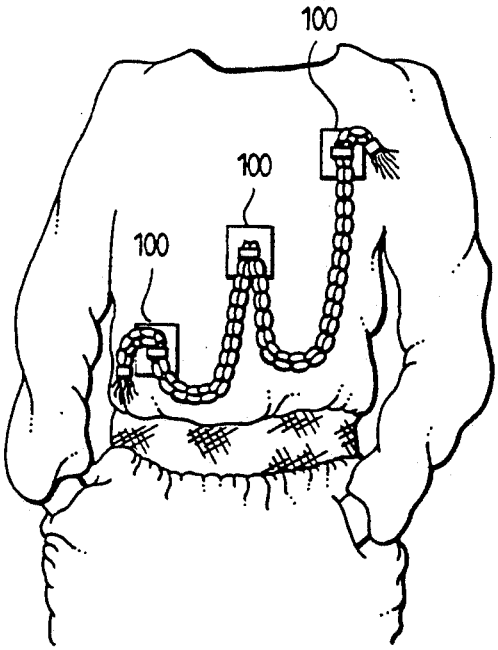

Designs other than an oval or circular configuration may be used for the hoop 50. For example, a parallelogram configuration, such as a rectangular or square design, may be used for the shape of the hoop 50, as shown in FIGS. 9F and 9G. Other alternative designs will be readily apparent to one skilled in the art, such as octagonal or triangular configurations, as shown in FIGS. 9E and 9F. These and other configurations may be used without departing from the principles of the present invention.

Figure 13:
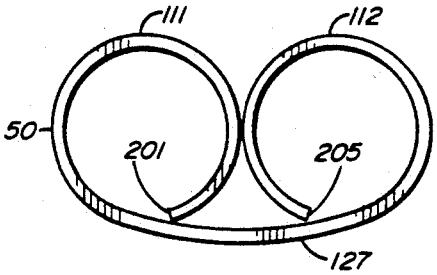
FIG. 13 is a cross-sectional view of the spring used in the multi-purpose pin structure of FIG. 1, drawn along line 13—13.

Referring now to FIGS. 1 and 13, the hoop 50 preferably has a scrolled cross-sectional configuration with a front portion 127 and two curved back portions 111, 112. The hoop 50 preferably is formed of a single sheet of suitable material, such as metal, plastic or cloth or any combination thereof, with a first end 201 and a second end 205.

Referring still to FIGS. 1 and 13, the front portion 127 of hoop 50 comprises the front surface of the hoop structure, which according to the preferred embodiment is curved. The front portion 127, however, may be flat or irregular. The first end 201 and second end 205 preferably are curved (or pre-formed) backwards and tucked under to press against the back surface of the front portion 127, thereby forming curved portions 111, 112. The curved portions 111, 112 abut each other to form a spring-like structure for receiving the pins 101, 102, 103 of backing 35. In the preferred embodiment, a plurality of grooves are provided on the curved portions 111, 112 to receive and guide pins 101, 102, 103.

Figure 7:
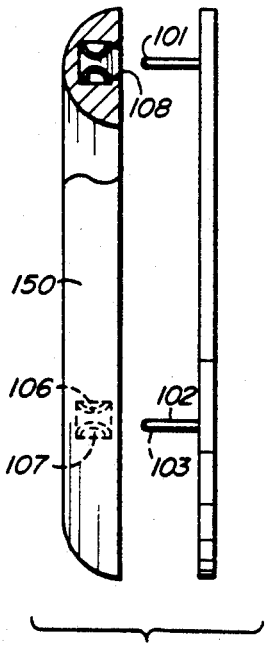
FIG. 7 is a partial, sectional side view illustrating an alternative fastening arrangement for the multi-purpose pin shown in FIG. 1.
Figure 9A:
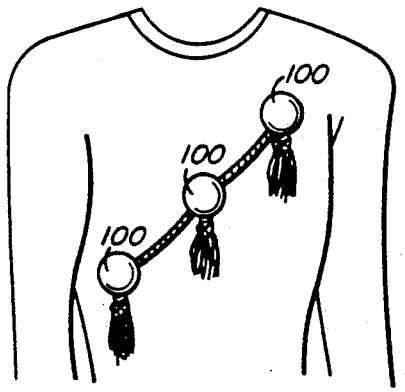
FIGS. 9A–9G are front views depicting the use of the multi-purpose pin.
Figure 9B:
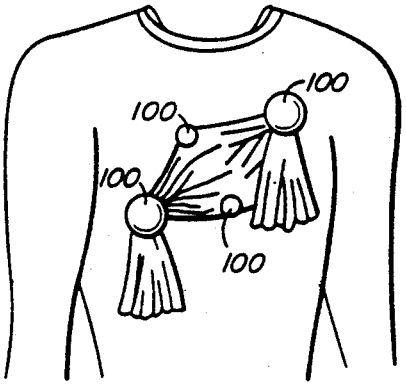
Figure 11:
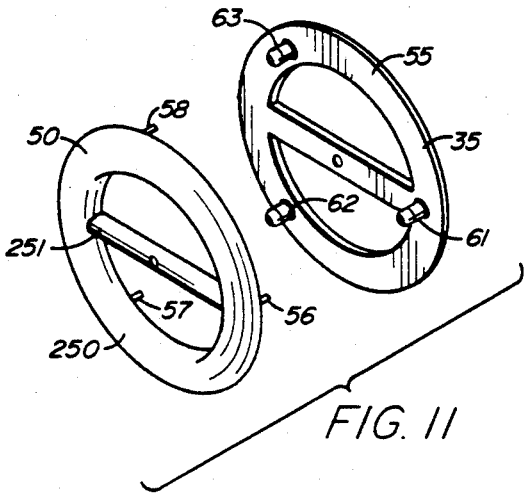
FIG. 11 is a perspective view of an alternative embodiment of a multi-purpose pin.

Alternatively, the hoop 150 may have a semi-circular cross-sectional configuration, as shown in FIG. 7. Various other cross-sectional configurations, such as circular or rectangular configurations, may be used without departing from the spirit of the present invention. In these alternative embodiments, various fastening means may be employed to-attach the hoop 50 to backing 35. An example of such a fastening means is shown in FIG. 11, wherein the hoop 250 includes a plurality of pins 56, 57, 58, with a length of approximately 0.5 inch, extending perpendicularly from the back surface of the hoop 250. The pins are spaced equidistantly around the hoop 250. In the embodiment of FIG. 11, a plurality of pin modules 61, 62, 63 are provided on backing 35 to receive pins 56, 57, 58.

Figure 12:
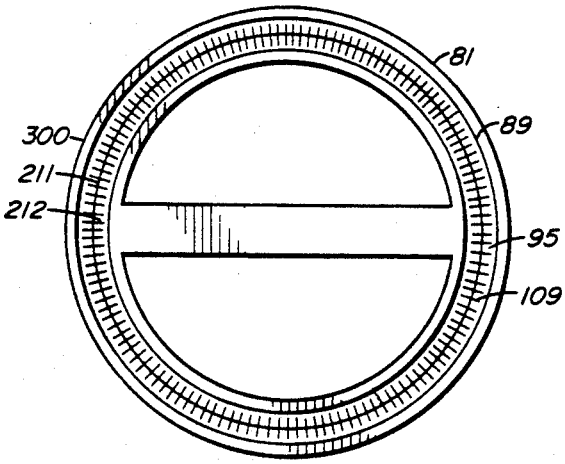
FIG. 12 is a back view of the preferred hoop structure of the multi-purpose pin shown in FIG. 1.

Another alternative fastening arrangement is shown in FIG. 12, wherein the hoop 300 has a semi-circular cross-sectional configuration, with a back side 81. The back side 81 of hoop 300 has a channel 89 formed therein for receiving a continuous spring 95.

Referring still to FIG. 12, the spring 95 has a scrolled configuration with a base portion and circular portions 211, 212 at respective ends of the base portion. The circular portions 211, 212 are positioned a short distance apart so as to securely receive pins 101, 102, 103 extending from the backing 35. The circular portions 211, 212 include a central groove 109 for receiving and guiding the pin extending from the backing 35. The base of spring 95 securely attaches to channel 89 by any suitable fastening means, such as by nails or rivets through the base and channel 89 of hoop 300. In this manner, the pins on backing 35 may be received by hoop 300 without requiring extensive alignment.

Figure 14:
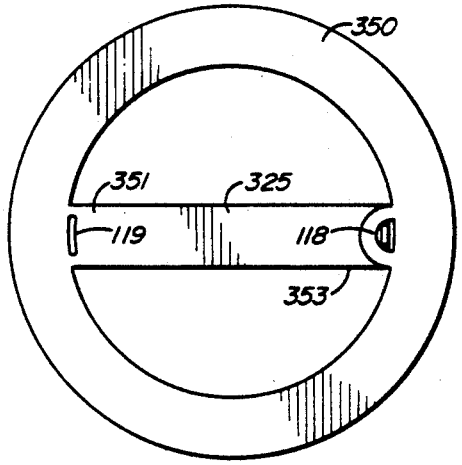
FIG. 14 is a front view of an alternative hoop structure.

Referring again to FIG. 1, bar 25 preferably has a length that is slightly less than the inner diameter of hoop 50. The first end 151 of bar 25 securely attaches to hoop 50, while an aperture 18 is defined between the second end 153 of bar 25 and hoop 50. Alternatively, as shown in FIG. 11, the bar 225 may have a length equal to the inner diameter of hoop 250. In this embodiment, the first end 251 and the second end 253 of bar 225 securely attach to hoop 250. In yet another alternative embodiment, shown in FIG. 14, the bar 325 may be movable along the horizontal axis. In the embodiment of FIG. 14, hoop 350 includes a clasp 118 defining a semicircular structure extending from the inner surface of hoop 350. In addition, hoop 350 includes a hinge 119 which fixedly attaches to the first end 351 of bar 325, therby allowing bar 325 to be movable horizontally. The second end 353 of bar 325 is removably attached to hoop 350 by clasp 118. As a result, bar 325 may be pivoted about hinge 119 and removed from clasp 118 to provide a space for inserting accessories which are continuous and do not have an end. After the accessory is inserted and wrapped around bar 325, the bar 325 may be pivoted so as to attach to clasp 118.

Preferably, the bar and hoop are formed as a single unitary structure. Preferably, bar 25 has a semi-circular cross-sectional configuration. In the preferred embodiment of FIG. 1, bar 25 bisects hoop 50, thereby dividing the interior portion of hoop 50 into two sections 165, 170 of approximately equal area.

Referring still to FIG. 1, bar 50 preferably includes a horizontal passage 43 extending therethrough for receiving jewelry items such as earrings or pins. Thus, passage 43 has a diameter which is sufficient to receive such jewelry items.

Referring still to FIG. 1, backing 35 may take a variety of shapes without departing from the principles of the present invention. In the preferred embodiment, backing 35 comprises a hoop 55, with a semi-circular cross-sectional configuration. Alternatively, backing 35 may comprise a hoop and bar structure, or may have a unitary circular configuration. Various cross-sectional configurations may be used for the backing 35 without departing from the principles of the present invention.

Referring now to FIGS. 1 and 7, backing 35 preferably is constructed of a light-weight material and includes pins 101, 102, 103 which are spaced equidistantly about the circumference of hoop 50 and extend perpendicularly therefrom. The pins 101, 102, 103 are received in the back side of hoop 50. Each of the pins 101, 102, 103 have opposed indentations (not shown) in the region where the pins 101, 102, 103 are maintained in contact with curved portions 111, 112 or spring 95, in accordance with conventional techniques to minimize slippage of the pins 101, 102, 103. In an alternative embodiment shown in FIG. 11, backing 35 includes pin modules 61, 62, 63 for securely receiving pins 56, 57, 58, which extend from the back of hoop 250.

In use, backing 35 is positioned underneath the clothing of a wearer. Hoop 50 and bar 25 are fixedly attached to the backing 35, with the clothing of the wearer between the backing 35 and the hoop 50 and bar 25. Pins 101, 102, 103 pass through the clothing and are received between curved portions 111, 112. In this manner, hoop 50 and bar 25 are secured to the clothing of the wearer. In a similar fashion, the multi-purpose pin 100 may be secured to the hair of a wearer by attaching hoop 50 and bar 25 to backing 35 with the hair positioned therebetween. Alternatively, hair can be wrapped with an accessory around bar 25, without backing 35. A decorative cover may be attached to the hoop 50, as described infra.

Referring now to FIGS. 9A-9G and 10, clothing accessories, such as scarves, rope or string may be attached to the multi-purpose pin 100 by inserting one edge of the cloth material 92 through section 114 of the hoop 50, on one side of bar 25. The material 92 then is pulled out the opposite side of bar 25, through section 116, so that the material 92 essentially is wrapped around bar 25. In the preferred embodiment shown in FIG. 1, aperture 18 is provided to permit the wearer to more easily wrap the clothing accessory around bar 25. In addition aperture 18 allows accessories which are continuous, without an end, to be wrapped around bar 25. Other ways to attach the material to the multi-purpose pin 100 will be described with reference to FIGS. 3–6.

Figure 10:
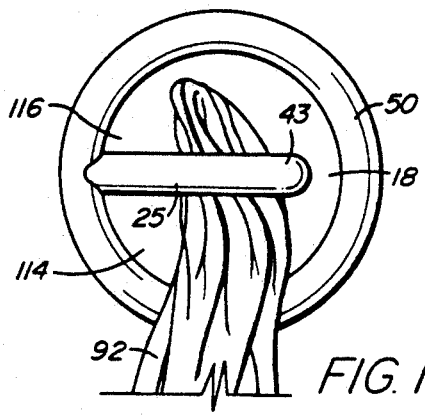
FIG. 10 illustrates the manner in which accessories are attached to the multi-purpose pin shown in FIG. 1.

Referring still to FIG. 10, a pin, an earring or other jewelry item may also be inserted into passage 43 in bar 25. The jewelry item may also attach to the material 92 to fasten the material 92 in place more securely.

Figure 2:
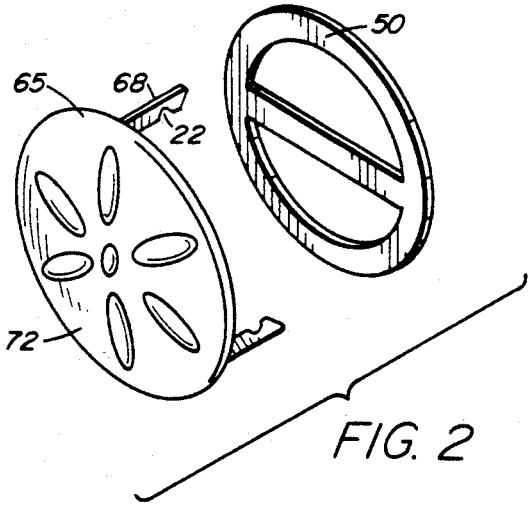
FIG. 2 is a perspective view of a decorative cover for use with the multi-purpose pin shown in FIG. 1.
Figure 15:
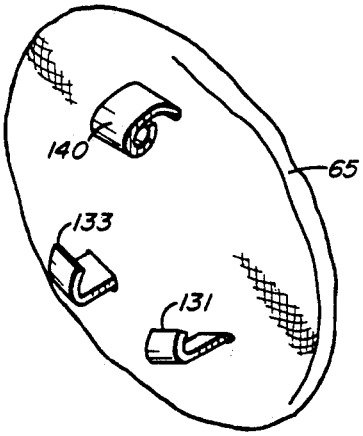
FIG. 15 is a perspective view of a preferred decorative cover for use with the multi-purpose pin of FIG. 1.

Referring now to FIGS. 2 and 15, a decorative top 65 may be provided for attaching to the front of hoop 50. As shown in FIG. 2, top 65 may include a decorative cover portion 72. The decorative top 65 includes fastening means extending perpendicularly from the back of the top 65. The preferred fastening mean shown in FIG. 15 comprises two "j" bar pieces 131, 133 spaced a distance apart and a leaf spring 140 for receiving hoop 50. The hoop 50 is secured in place by positioning one side of hoop 50 under the "j" bars 131, 133 and thereby positioning the other side of hoop 50 over leaf spring 140. Pressing the hoop 50 against leaf spring 140 momentarily displaces the leaf spring 140 to thereby secure hoop 50 under the leaf spring. As will be apparent to one skilled in the art, various other fastening means may be employed without departing from the principles of the present invention. For example, as shown in FIG. 2, a fastening means may be used which includes a plurality of rigid members 68 with a groove 22 defined on the interior surface of the members 68. The rigid members 68 are equally spaced about the circumference of the cover portion. The decorative top 65 attaches to the hoop 50 by securing the outer edges of hoop 50 in grooves 22.

Decorative top 65 may be used to cover hoop 50 after clothing material has been secured by hoop 50 and bar 25. Alternatively, decorative top 65 may be used with multi-purpose pin 100, without any accessories, as a piece of jewelry. The decorative top 65 may take various geometric configurations and sizes, independent of the size and shape of the hoop 50, as shown in FIGS. 9D and 9E without departing from the scope of the invention. The decorative top 65 may be formed of metal, plastic or cloth as desired.

Figure 3:
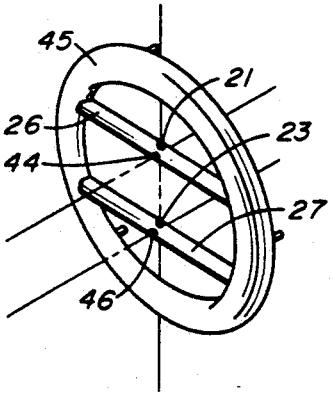
FIG. 3 is a perspective view of an alternative oval hoop structure for use in the multi-purpose pin of FIG. 1.

Referring now to FIGS. 3, 4, 5, and 6, alternative hoop designs may be utilized without departing from the principles of the present invention. Referring to FIG. 3, a hoop design may be provided that includes a hoop 45 and two parallel bars 26, 27. Parallel bars 26, 27 serve to divide the interior portion of hoop 50 into three portions 73, 77, and 81. Middle portion 81 comprises a generally rectangular shape, while end portions 73, 77 are of approximately the same semicircular area.

Bars 26 may include a horizontal passage 44 while bar 27 may include a horizontal passage 46. Passages 44, 46 receive jewelry items such as pins or earrings therethrough. In addition, bar 26 may include a vertical passage 21, while bar 27 may similarly include a vertical passage 23. Vertical passages 21, 23 preferably have the same vertical axis to permit a jewelry item, such as a pin, to pass through both passage 21 and passage 23.

In the embodiment of FIG. 3, clothing material may be secured to hoop 45 by wrapping the material around one or both of bars 26, 27 in a variety of fashions, as will be evident to one skilled in the art. In addition, pins or earrings may be placed through horizontal passage 44, 46 and/or vertical passages 21, 23.

Figure 5:
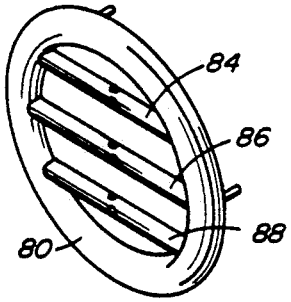
FIG. 5 is a perspective view of an alternative oval hoop structure for use in the multi-purpose pin of FIG. 1.

Referring now to FIG. 5, a hoop design may be provided comprising a hoop 80 and three bars 84, 86, and 88. As in the hoop design of FIG. 3, bars 84, 86, and 88 may also include horizontal and vertical passages therethrough.

Figure 4:
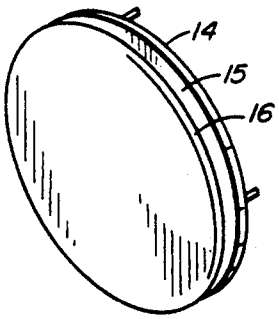
FIG. 4 is a perspective view of an alternative oval hoop structure for use in the multi-purpose pin of FIG. 1.
Figure 6:
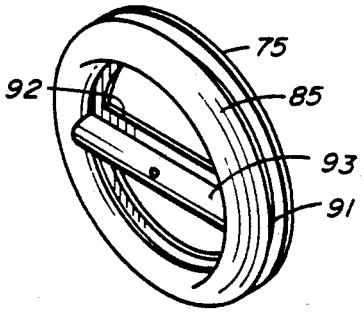
FIG. 6 is a perspective view of an alternative oval hoop structure for use in the multi-purpose pin of FIG. 1.

Referring now to FIG. 4 and 6, the hoop structure may include two oval or circular pieces positioned a fixed distance apart, with a bridge formed therebetween to define a groove between the two pieces. Referring now to FIG. 4, a first circular disc 14 and a second circular disc 16 are provided in spaced relation. A U-shaped bridge is provided between the two discs 14, 16 at the circumference of the discs to define a groove 15. The second circular disc 16 may include a decorative frontal portion 19 to provide ornamentation. Cloth material, such as string, rope or scarves may be wrapped around the circumference of the pin of FIG. 4 by positioning the material in groove 15.

Similarly, as shown in FIG. 6, a pair of opposed hoops 75, 85 with central bars 92, 93 are positioned in parallel, a fixed distance apart from each other. The hoops 75, 85 may comprise two identical hoops 50, shown in FIG. 1, placed back-to-back. A U-shaped bridge may be provided to form a groove 91 around the circumference of the pin, between hoops 75, 85. In the pin embodiment shown in FIG. 6, clothing material may be wrapped around the circumference of the pin in groove 91, or around the central bars 92, 93 as described in reference to FIG. 1.

Figure 8:
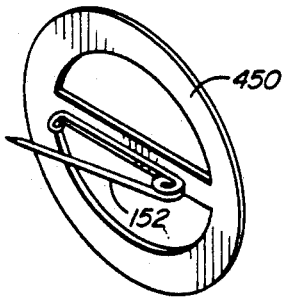
FIG. 8 is a perspective view of the back of an alternative fastening arrangement for the multi-purpose pin shown in FIG. 1.
Figure 9C:
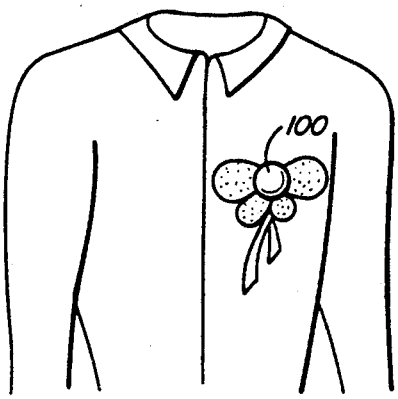

A number of alternative fastening means may be used to secure the pin to the clothing of the wearer, other than the arrangements described supra. For example, as shown in FIG. 7, pins 101, 102, 103 may extend perpendicularly from the surface of backing 35, while hoop 150 may include recessed receptacles 106, 107, 108 for receiving pins 101, 102, 103. Alternatively, as shown in FIG. 8, a clothes pin type of attachment 152 may partially lie within the back of bar 25. In this manner, hoop 450 may be pinned to the clothing of a wearer.

While a preferred embodiment and certain alternatives have been described herein, one skilled in the art will realize that other alternative embodiments may be made without departing from the principle of the present invention.

I claim:

1. A multi-purpose pin, for attaching to the clothes, hat, or hair of a wearer, for supporting accessories, comprising:

means for supporting an accessory on the wearer, wherein said supporting means includes a hoop;

means for dividing the interior area of the hoop into a plurality of section; said dividing means comprises a bar which bisects the interior area of said hoop and which includes a lateral horizontal passage for receiving jewelry accessories;

means for fastening the hoop to the wearer;

whereby a clothing accessory may be passed through the hoop and wrapped around the dividing means for securing the clothing accessory to the clothes of the wearer.

2. A multi-purpose pin as in claim 1, further comprising a decorative top for fastening to said hoop.

3. A multi-purpose pin as in claim 1, wherein said dividing means comprises a plurality of bars for dividing the interior area of said hoop into sections.

4. A multi-purpose pin as in claim 1, wherein said bar includes a first passage orthogonal to said bar for receiving jewelry accessories.

5. A multi-purpose pin as in claim 4, wherein said bar includes a second passage orthogonal to said bar and to said first passage for receiving jewelry accessories.

6. A multi-purpose pin as in claim 1, wherein said bar includes a vertical passage for receiving jewelry accessories.

7. A multi-purpose pin as in claim 1, wherein said hoop includes a groove along the circumference thereof for receiving the clothing accessory.

8. A multi-purpose pin as in claim 1, wherein said hoop has a circular configuration.

9. A multi-purpose pin as in claim 1, wherein said decorative top has a circular configuration.

10. A multi-purpose pin as in claim 1, wherein said bar has a first end which attaches to said hoop and a second end which defines an aperture between said bar and said hoop.

11. A multi-purpose pin as in claim 1, wherein said bar has a first end which attaches to said hoop and a second end which is removably attached to said hoop.

12. A multi-purpose pin as in claim 1, wherein the back side of said hoop has a channel with a continuous spring therein for securely receiving a backing portion.

13. A multi-purpose pin as in claim 1, wherein said means for fastening includes a backing portion and said hoop includes two curved back portions for securely receiving the backing portion.

14. A multi-purpose pin as in claim 13, wherein a plurality of grooves are provided on the curved back portions;

and said backing includes a plurality of pins extending therefrom, and said grooves receive and guide said pins between said curved back portions.

15. A multi-purpose pin, attached to the clothing, hat, or hair of a wearer, for supporting accessories, comprising:

means for supporting a clothing accessory on the wearer;

fastening means attached to said supporting means for fastening said supporting means to the clothing, hat or hair of a wearer;

wherein said supporting means includes a first circular disc and a second circular disc spaced in parallel, with a bridge formed therebetween to define a groove between said first and said second discs for receiving the clothing accessory.

16. A multi-purpose pin as in claim 15, wherein said first circular disc comprises a first hoop and said second circular disc comprises a second hoop.

17. A multi-purpose pin as in claim 16, wherein said first hoop includes a bar bisecting the interior area thereof.

18. A multi-purpose pin for attaching to the clothes or hair of a wearer, comprising:

a hoop;

means for fastening the hoop to the wearer;

means for dividing the interior area of the hoop into a plurality of sections, wherein said dividing means includes an aperture therethrough for receiving a jewelry accessory.

19. A multi-purpose pin as in claim 18, further comprising a decorative top for fastening to said hoop.

* * * * *